United States Patent [19]

Hauslaib

[11] Patent Number: 4,707,157

[45] Date of Patent: Nov. 17, 1987

[54] MATRIX PRINTER WITH ELECTROSTATIC DISCHARGE

[75] Inventor: Wolfgang Hauslaib, Langenau, Fed. Rep. of Germany

[73] Assignee: Mannesmann AG, Duesseldorf, Fed. Rep. of Germany

[21] Appl. No.: 766,046

[22] Filed: Aug. 15, 1985

[30] Foreign Application Priority Data

Aug. 16, 1984 [DE] Fed. Rep. of Germany ..... 3430091

[51] Int. Cl.[4] ..... B41J 11/26; B41J 29/02

[52] U.S. Cl. ..... 400/616; 400/694; 400/719; 101/416 R; 271/209; 220/199; 361/214

[58] Field of Search ..... 400/616, 691, 693, 694, 400/578, 584, 616.2, 719, 618; 271/208; 226/196, 199; 101/416 R; 361/214

[56] References Cited

U.S. PATENT DOCUMENTS

| | | | |
|---|---|---|---|
| 1,668,049 | 5/1928 | Clinton et al. | 361/214 |
| 2,207,677 | 7/1940 | Chapman | 361/214 X |
| 3,157,330 | 11/1964 | Manor et al. | 400/616 X |
| 3,799,313 | 3/1974 | Shevick | 400/616 X |
| 3,921,037 | 11/1979 | Testone | 361/214 |
| 4,500,023 | 2/1985 | Akazawa | 226/199 X |

FOREIGN PATENT DOCUMENTS

| | | | |
|---|---|---|---|
| 629467 | 10/1961 | Canada | 271/208 |
| 3422633 | 12/1985 | Fed. Rep. of Germany | 361/214 |
| 146591 | 11/1979 | Japan | 361/214 |
| 0448682 | 9/1982 | Japan | 400/694 |

*Primary Examiner*—Edgar S. Burr
*Assistant Examiner*—James R. McDaniel
*Attorney, Agent, or Firm*—Ralf H. Siegemund

[57] ABSTRACT

Matrix printers exhibit the tendency to develop electrostatic charges on account of various movements in sliding contact between the print medium such as paper on one hand and the transport device and print styli or hammer on the other hand. In order to eliminate these charges the traction means for transporting the paper is driven by a drive shaft which is held in electrical insulation from the transport device but is electrically connected through a paper support structure which is in turn is electrically connected to a connecting rod completing a frame structure for the transport device.

5 Claims, 3 Drawing Figures

MATRIX PRINTER WITH ELECTROSTATIC DISCHARGE

BACKGROUND OF THE INVENTION

The present invention relates to matrix printer with transport facilities for a print medium being perforated along longitudinal edges whereby particularly the transport facilities constitute a frame which includes lateral carrier arms being connected in parallel by means of a connection rod as well as a rotatable drive rod; moreover this connection rod and the drive shaft carry parallel slidable and axially symmetrically arranged traction devices.

Transport devices of the type to which the invention pertains and being generally of a nature outlined above are used in matrix printers to advance edge perforated paper sheets or the like which are to be moved in steps or continuously during the matrix print process in which characters are printed on that paper. The print medium may consist of a single sheet or several superimposed paper sheets or webs with inserted carbon layers or the equivalent in order to print multiple copies. Matrix printers are usually equipped with motors, possibly separate motors, for driving the paper transport device, the ink ribbon as well as the print head or a print element carrying shuttle, carriage or the like. Furthermore, the housing or casing of the printer accommodates printed circuit boards carrying electronic control and switching circuits, logic circuits etc. and particularly all relevant electronic components such as diodes, transistors, resistors, capacitors, inductors, integrated circuits etc. These circuit elements together are provided in order to control the print process which includes the formation of characters as well as the control of the various motors or other facilities for controlling paper advance, ink ribbon advance, carriage or shuttle movement and so forth.

It was observed that during operating the electromotors but also the electric and electronic circuits certain structural components of the matrix printers which are not immediately participating in the circuit may receive an electric parasitic charge which interferes with printer operation. Also it has been observed that upon printing by means of needles, styli or the like the engagement with the paper produces such electrostatic charges. The same is true in an augmenting fashion when the paper is frictionally engaged with various parts and guide elements, and this sliding contact clearly contributes to the generation of electrostatic charges. These charges are actually rather elusive and cannot be ascertained definitely and localized during long term printer operation. Therefore there is a danger that electric currents are produced or induced being of a parasitic nature and in an unforeseeable manner penetrate into the electric or electronic circuit elements and interfere with their proper function. It has actually been observed that these currents reach the printer drives and cause its turn-off.

DESCRIPTION OF THE INVENTION

It is an object of the present invention to overcome the problems outlined above generally and to eliminate electrostatic charges at least in one or more critical zones or areas within a matrix printer.

It is a specific object of the present invention to provide a new and improved transport device for edge perforated print media so that neither the printing nor the transport of the medium is capable of producing lasting parasitic electrostatic charges.

In accordance with the preferred embodiment of the present invention the object and here particularly the specific object is obtained by providing a metallic drive shaft for a tractor or a pair of tractors and for electrically insulatively mounting that shaft in a carrier structure for the transport device in general, and that means are provided for conducting any electrostatic charges from rotating shaft via nonrotating structure within the frame structure for the transport device, into the printer casing or chassis via a connection rod. It was found, as a matter of practical application, that using these features the printing function is not interfered with and no longer are electrostatical discharges observed as they may have detrimental effects on operating personnel. The key is an electrical connection between the metal nonrotating rod and the rotating but insulated drive shaft for the traction device which establishes the basic element for the frame and the chassis. Thus this particular portion of the transport device constitutes an electrical conductor having a very low electrical resistance so that any high voltage that may tend to develop is easily conducted through currents of low density into the printer chassis.

A practical embodiment for practicing the invention is preferably to be seen in that the means for discharging the electrostatic charges are provided in and as part of support structure for the print medium such as paper which support structure is arranged between the edge engaging traction devices and is movable on the above mentioned connecting rod as well as the common drive shaft for the two tractor devices. Owing to its slidability this support structure in conjunction with a requisite parallel position. This support structure is slidably connected to the connecting rod and the drive shaft which extend parallel to each other. This construction is particularly favorable for conducting charges out of the system. Further transfer of charges can be enhanced in that the above mentioned slidable support structure is constructed as an electrically insulated casing through which the drive shaft runs and is held therein in a bearing and sleeve bushing made of electrically conductive material and that this bushing is also electrically connected with the above mentioned connecting rod by sliding brush means or the like. The desired contact for channelling charges out of the transport system by means of the two principle conductors (shaft and connecting rod) is enhanced if the aforementioned sleeve bushing is further connected to the rod by means of a biased leaf spring being situated in a groove of the sleeve. This way, shaft and connecting rod are electrically connected in a highly localized manner which is the basic feature of charge channelling.

Generally speaking the principle of discharging electrostatic charges in matrix printers can be used wherever electrical and electronic elements, groups, modules, circuits are in fact connected to ground and where care has been taken to connect that ground to the metallic connection rod constituting the frame structure for the traction device for the paper advance.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings FIG. 1 illustrates a transport and traction device 6 generally for a print medium such as paper having perforated edges in which sprockets 12 can be inserted for affecting the transport. The transport device 6 as shown in FIG. 1 is shown in operating condition. The device includes a self carrying frame which includes two side carrier arms or bar *7a* and *7b* which are interconnected by means of a connecting rod 8 and by means of a drive shaft 9. The drive shaft 9 is mounted for rotation in the carrier *7a* and *7b* whereby a gear 25 on shaft 9 at the left side actually constitutes the rotatable element that is being mounted for rotation while the right hand rotational mounting is established by a cap bearing 35. Elements 25 and 35 electrically isolate metal shaft 9 from elements *7a* and *7b*, but metal rod 8 electrically interconnects arms *7a* and *7b* which in turn are electrically connected to the chassis 50.

Figure 1:
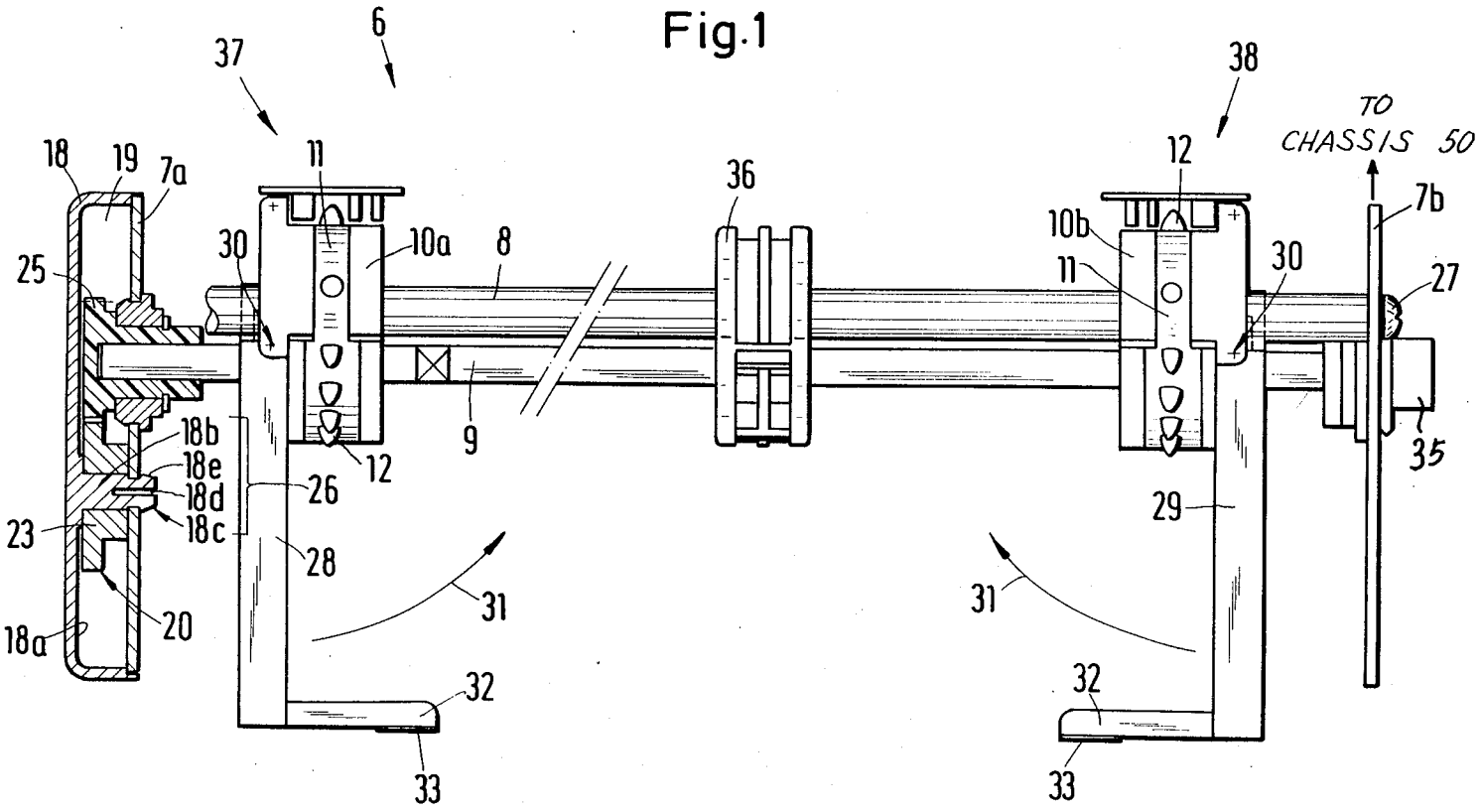
FIG. 1 is a front view of a transport device in a matrix printer constructed in accordance with the preferred embodiment of the present invention for practicing the best mode thereof and showing drive elements as well as certain parts and cross sections.

The connection rod 8 on one hand and the drive shaft 9 on the other hand together with side bars, arms or carriers *7a* and *7b* establish a frame. Herein elements 8 and 9 run parallel to each other, so do elements *7a* and *7b*.

Tractor or traction devices 10*a* and 10*b* including the sprockets 12 mentioned earlier and arranged for example in axial symmetry on connecting rod 8 as well as on the drive shaft 9. These traction devices 10*a* and 10*b* are slideable on these elements 8 and 9 so as to be adjusted to a particular width of the print medium or kind of paper. Each of the traction devices include an endless belt 11 with inwardly directed teeth, notches or perforation not shown, for purposes of providing a geared and sprocket like transport of the belts themselves. On the outside of the belts 11 are arranged the already mentioned follow-up pins or sprockets 12.

The pinion or gear 25 is contained in a casing 18 which is also a cover and can be made of a die cast material such as a synthetic. The cover 18 and the side carrier *7a* together consitute a casing 19 which protects generally a reducing gear 20. A gear stage, intermediate gears such as the gear 23, as well as another gear stage are provided herein casing 19 and establish reducing gear 20 whereby the last gear 25 is in fact mounted to the drive shaft 9 for rotation therewith, in other words the gear 25 in fact imparts immediate rotation upon that shaft 9, which then is used to drive the traction devices.

The inside 18*a* of cover 18 is provided with bearing pins 18*b* which have been integrally formed by the die casting process by means of which cover 18 is being made. The intermediate gears mentioned above are journalled and mounted for rotation on these pins 18*b*. The side carrier *7a* guides the gears or intermediate gears by means of bearing support step. The pins 18*b* are provided respectively with peaks or points 18*c*, being provided with slots 18*d* and having also step 18*e* so that as result thereof a latching element 26 is composed of the through bores, the step 18*a* and the slot 18*d*.

Connection rod 8 is axially adjustable by means of adjusting screws 27 which are situated and bear onto the element 8 from outside the side bars or arms *7a* and *7b*. This adjustment serves to provide for an accurate parallelism between the side bar *7a* and *7b*. That feature in turn entails parallelism between the connecting bar 8 and the shaft 9. Guide sheets 28 and 29 are respectively provided on the tractor devices 10*a* and 10*b* which guide structures can be folded by means of hinges 30 in direction of arrow 31 for purposes of transporting the traction device. During operation, however, these folded-up side walls and guide walls 28 and 29 guide the print medium i.e. paper sheet laterally. In transport position the guide walls 28 and 29 are situated parallely to the rod 8 as well as to the drive shaft 9.

In addition to lateral guiding and restraining by means of walls 28 and 29, a guide structure is provided from below for guiding the print medium and for this, walls 28 and 29 carry pivotal wings 32. At the end thereof the pivoting is permitted in direction of arrow 31. These wings 32 support the record medium and the print paper from below. The wings 32 themselves form a nose which upon appropriate configuration of the frame reaches into a latching space whereby for the print medium certain gap is provided. Another improvement of the guide for the paper can be seen in a support 36 mounted on as well as being slidable on the connection rod 8 as well as the drive shaft 9. This support 36 should also be centered in between the two traction devices 10*a* and 10*b*. This device 36 is now used as an essential element in the construction as per the present invention.

The support 36 held on the rods 8 and 9 between the traction devices 10*a* and 10*b* is in good (firm) electrical contact with both the metallic element 8 and 9. On the other hand drive shaft 9 has, as stated, its two ends supported in electrically insulating synthetic elements (25, 35). In the left hand side of FIG. 1 this insulation is in fact established by the gear 25. On the right hand side the insulation is established by the sleeve bearing 35 made of synthetic and by means of which the shaft is rotatably mounted in part *7b*. It can thus be seen that the metallic shaft 9 is electrically insulated from the carrier *7a* and *7b*. The drive shaft 9 is, on the other hand, an electrical conductive connection with the traction devices 10*a* and 10*b*. Therefore the drive shaft 9 is the principal recipient of electrostatic charges from the traction devices as they engage the paper in which as a dielectric material charges are induced and accumulated. These electrical charges therefore are conducted into the drive shaft 9 but through the insulation are kept away from the carrier *7a* and *7b* at that point. This is important as this way the unlocalized development of charges is prevented from randomly reaching frame elements *7a* and/or *7b* and, therefore, different portions of the chassis 50. On the other hand it was stated that the support 36 is in electric contact with the shaft 9. Herein it is to be observed that the print medium is likewise in a contact possible in frictional contact with the support 36 so that electrostatic charges induced here are conducted from the paper into the support 36 being in electric conductive contact with the shaft 9.

Figure 2:
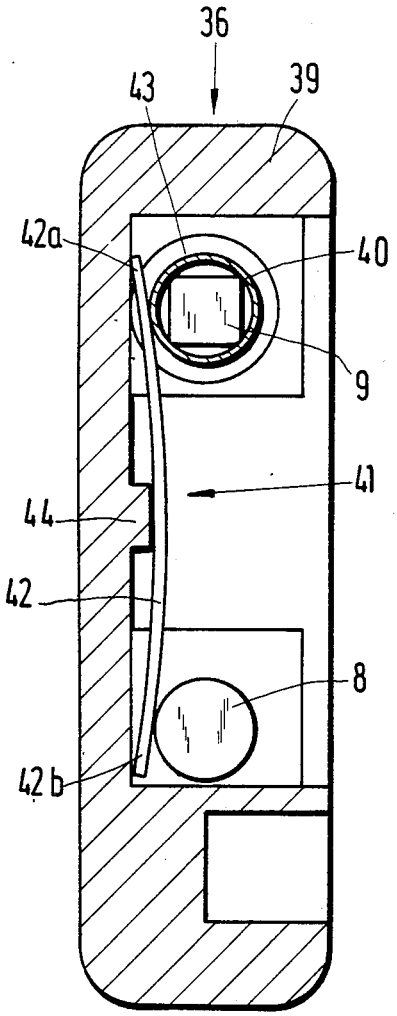
FIG. 2 is a cross section through a particular support used in the equipment shown in FIG. 1 and on an enlarged scale.
Figure 3:
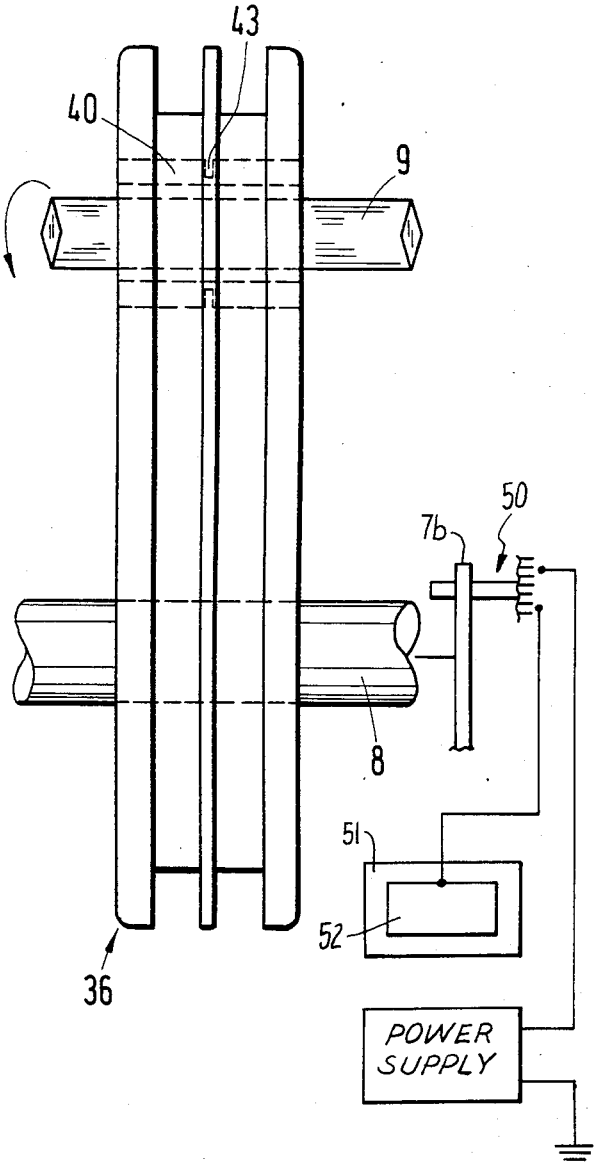
FIG. 3 shows the same support structure shown in FIG. 1 but in a front view view as such being similar to that in FIG. 1 but FIG. 3 is on a larger scale and includes representation of electric connections.

It can thus be seen the structure 9 and 36 serves as an electrical conductor for accumulating concentrating and localizing electrical charges and conducting them away from the paper and in whatever situation they may arise. The support 36 on the other hand is comprised as shown more fully in FIGS. 2 and 3. The shaft 9 is supported by means of a sleeve bearing 40. The sleeve bearing 40, however, is also made of an electrically conductive material just as is the shaft 9. It was found to be of advantage to construct the sleeve 40 of bronze. Sleeve 40 is additionally electrically conductively connected to the metallic rod 8 by means of an electric conductor 41 being in sliding contact with the rod 8 which means that the charges which are accumulated and flow in the shaft 9 and into the sleeve 40 will now be conducted into the connection rod 8. This connection channels the flow of charges wherever they have been produced by friction.

The contact between sleeve 40 and the shaft 9 as well as with the connecting rod 8 is maintained by means of electrical conductors 41 including a leaf spring 42. A groove 43 is centrally located in the sleeve 40 in which the spring 42 is laterally guided. The leaf spring 42 has ends 42*a* and 42*b* by means of which it bears respectively against the sleeve as well as against the connecting rod 8 and the spring bears centrally against a projection 44 from the housing 39 in order to maintain its position. Moreover this projection 44 biases the leaf spring 42 so that its end can in fact maintain electrical connection as between the sleeve 40 and the connecting rod 8.

The principle of conducting or removing electrostatic charges which can form generally in the area of the printhead but primarily in the immediate and direct vicinity with the dielectric print medium can, therefore be developed further particularly in any transport device for that print medium wherever such charges may become unforseeably distributed in the circuit. The structure presently shown demonstrates that the charges be collected and channeled for definite flow into the chassis 50. One has to consider also here that the various electronic and electric circuit elements, components, groups, modules, IC-s etc. are provided with ground shield 52 (see e.g. PC board 51) grounded structure. They are also connected to the chassis 50. If now a connection is made as suggested between all those components and the transport and print structure which can develop electrostatic charges such that with certainty and here particularly through the connecting rod 8 charges are distributed into the chassis, then these circuit components 51 and others will be protected from these excess charges while uniformity in potential (zero, ground) distribution in the chassis will prevail.

The invention is not limited to the embodiments described above but all changes and modifications thereof, not constituting departures from the spirit and scope of the invention, are intended to be included.

I claim:

1. In a matrix printer having a chassis and facilities for the advance of edge perforated print material and including particularly traction devices engaging the perforations for advancing the print medium through the printer, a structure for preventing the development of electrostatic charges comprising in combination:

a pair of lateral carrier arms being connected to the chassis:

a drive shaft journalled for rotation in said carrier arms and being mounted therein to be electrically insulated from the carrier arms, there being means interposed between the arms and the drive shaft for providing electrical insulation as between the drive shaft and the carrier arms, the drive shaft itself being electrically conductive and also electrically connected with the traction means;

a metallic connecting rod interconnecting said carrier arms in electrically conductive relation so that the carrier arms, the drive shaft, and the connecting rod constitute an electrically conductive frame for holding the transport device; and means including a support which rides on said connecting rod and said drive shaft. for providing electrical connection between said drive shaft and said connecting rod to thereby discharge electrical charges into the chassis.

2. Device as in claim 1 wherein said support includes an electrically insulated housing, a conductive bearing sleeve receiving said drive shaft and slide connection means electrically interconnecting said bearing sleeve with said connecting rod.

3. Device as in claim 2 wherein said connection means include a leaf spring held in a groove being peripherally arranged in said bearing sleeve.

4. Printer as in claim 3 including means for tension biasing said leaf spring.

5. Printer as in claim 1 including means for electrically connecting ground plates in electric circuit elements to said connecting rod.

* * * * *